United States Patent [19]

Veroef

[11] 4,284,238

[45] Aug. 18, 1981

[54] RAIL FASTENERS

[75] Inventor: Hendrikus M. Veroef, Gepp's Cross, Australia

[73] Assignee: Ralph McKay Limited, Victoria, Australia

[21] Appl. No.: 51,979

[22] Filed: Jun. 25, 1979

[30] Foreign Application Priority Data

Jul. 4, 1978 [AU] Australia ..... PD4945

[51] Int. Cl.[3] ..... E01B 9/30

[52] U.S. Cl. ..... 238/349; 238/351

[58] Field of Search ..... 238/310, 338, 349, 351, 238/354, 315

[56] References Cited

U.S. PATENT DOCUMENTS 1,264,616 4/1918 Delker ..... 238/349 X

FOREIGN PATENT DOCUMENTS 670649 9/1963 Canada ..... 238/349
2106853 9/1971 Fed. Rep. of Germany ..... 238/349
1217331 12/1970 United Kingdom ..... 238/351

*Primary Examiner*—Randolph A. Reese
*Attorney, Agent, or Firm*—Christel, Bean & Linihan

[57] ABSTRACT

A rail clipholder for a rail clip is formed from metal plate which is bent into a U shape in cross-section. The walls of the U shaped clipholder are slotted to accommodate a portion of a rail clip. The clipholder is securable to a sleeper adjacent a rail so that the remaining portion of the rail clip lies on the foot of the rail.

2 Claims, 2 Drawing Figures

RAIL FASTENERS

This invention relates to railway fastening systems and in particular to an improved rail clip holder.

A popular rail clip is a D shaped clip in which the free ends of the clip lie adjacent each other, one free end lying on the foot of the rail and the other being held in a rail clip holder. Generally the rail clip holders are castings including a portion adapted to secure the holder to a sleeper and a recessed portion adapted to receive a free end of a rail clip.

The castings are expensive to produce and require a large metal content to which also contributes to cost. The castings need to be relatively heavy and to include thick flanges in the recessed portion to retain the free ends of the clip in position.

It is an object of this invention to provide a simple alternative form of clip holder which is cheaper to produce, contains less metal and is still as effective functionally as previous clips.

To this end the present invention provides a rail clip holder for a rail clip of the kind in which one portion of the clip seats in the clipholder secured to a rail sleeper and an other portion of the rail clip lies on the foot of the rail, said clipholder being formed from metal plate in which the plate is bent into a general U shaped body portion the sides of the U being slotted toward the base of the U said slots being adapted to receive said one portion of the rail clip.

By providing a rail clip holder in plate metal the holder can be easily and cheaply produced by stamping and bending. The U cross section of the plate is in the horizontal plane and the slot is also approximately horizontal so that any stress on the clipholder is in the plane of the metal plate and does not produce a significant bending moment on any section of the plate as the moment arm in any stress location is of very short length. This design enables relatively light weight plate to be used so that compared to conventional clip holders less material is used resulting in a lighter and cheaper clip holder.

The sides of the plate are preferably arranged to slope inwardly to guide the clip into the correct position and also to enable insertion of a portion of the clip into the slots. Further the free ends of the clip are compressed so that when they pass beyond the sides of the clip they will expand and abut the ends of the clip side walls to be thereby retained in position.

Figure 1:
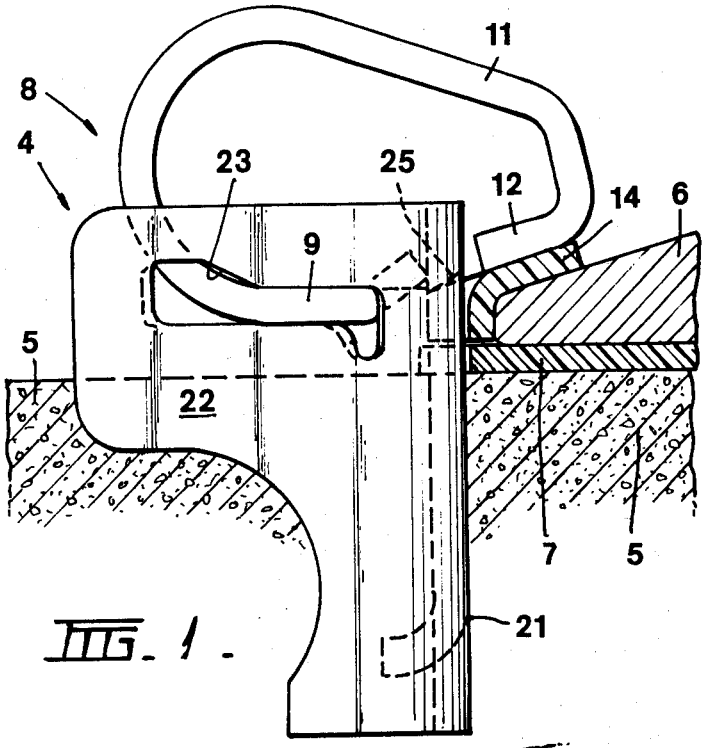
Figure 2:
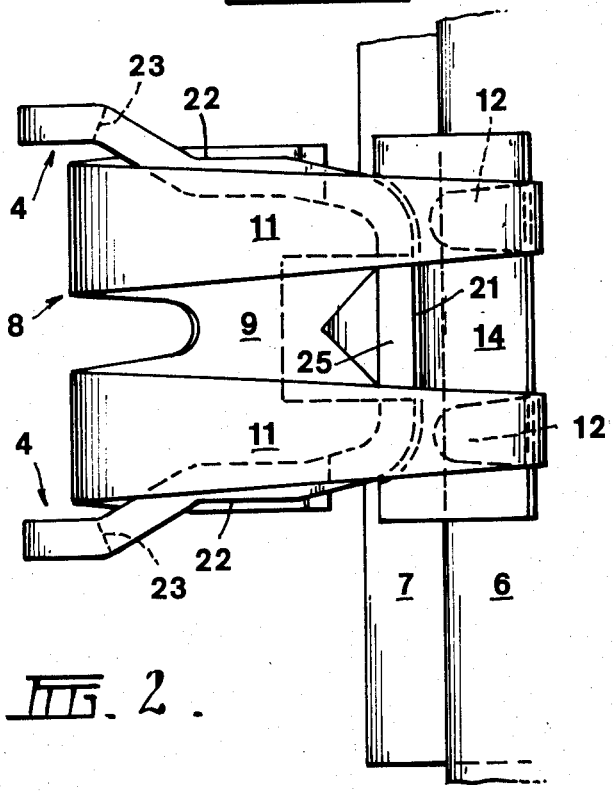

A preferred embodiment of the invention is illustrated in the accompanying drawings in which FIG. 1 is a side elevation and FIG. 2 is a plan view of a clip and clip holder.

The clip holder 4 is cast into a concrete sleeper 5 on which rests the rail 6. The rail 6 is separated from the sleeper 5 by an insulation pad 7. The rail clip 8 is secured by clip holder 4 and the clip in turn secures the rail 6 into position.

The clip comprises a base portion 9 from which extend in D configuration two arms 11 which terminate in the ends 12. These ends 12 of the clip 8 press down on the rail 6. An insulator 14 separates the rail 6 of the clip 8.

The clip holder 4 is shaped from metal plate into a general U shape as shown in FIG. 2 there being a central section 21 parallel to the rail and side walls 22 which taper outwardly in a number of segments. The slots 23 extend through three of the tapered segments of the side walls 22. The side edges of base 9 of the rail clip 8 seat within the slots 23 of the clip holder 4. The tapering of the clipholder side walls 22 means that the ends 12 of the clip are compressed as the clip is pressed into the clip holder. However, these ends spring apart once the free ends 12 clear the end of the side walls 22. The central section 21 is of lower height than side walls 22, and includes a chamfered upper surface 25 which raises the free ends 12 of the clip 8 onto the surface of the insulator 14.

The lower section of the clip holder 4 is conveniently shaped to enable the clipholder to be securely held in the sleeper which in the embodiment shown is a concrete sleeper.

The clipholder 4 can be stamped from metal plate to form the overall shape and to form the slots 23. Subsequent to stamping the metal plate can be bent or pressed to form the plan section as shown in FIG. 2. Because the clip 8 is held in position onto the rail 6 of the base section 9 within the slots 23 all the stress on the clip holder is within the plane of the metal plate and does not create any significant bending moment. Thus the clip holder 4 are lighter and cheaper than conventional clip holders and in addition are more easily made in large numbers.

I claim:

1. A rail clip holder for a rail unitary clip of the kind in which one portion of the clip seats in the clipholder secured to a rail sleeper and another portion of the rail clip lies on the foot of the rail, said clipholder comprising a channel section of plate metal adapted to be disposed vertically when secured to the rail sleeper, said channel section comprising a base having a longitudinal axis and oppositely-directed surfaces and a pair of spaced-apart side portions extending from one of said base surfaces and each terminating in an outer edge spaced from said base surface, said side portions and said base surface defining therebetween a region which is completely empty except for the clip, when said clip is in operative engagement with a rail, the base of said channel section being adapted for location adjacent the foot of the rail with the other base surface disposed toward the rail and a pair of elongated slots, one in each of said side portions of said channel section, each of said slots extending in a direction from the outer edge of the corresponding side portion toward said one base surface and generally perpendicular to said longitudinal axis of said base whereby said slots are disposed substantially horizontally when said channel section is secured to said sleeper and said slots are adapted to receive said one portion of the rail clip and are the sole means of retaining said clip in operative engagement with said rail.

2. A rail clip holder as claimed in claim 1 in which each of said side portions of the clipholder has a section which diverges from said base portion.

* * * * *